US007357383B2

(12) United States Patent
D'Alessandro et al.

(10) Patent No.: US 7,357,383 B2
(45) Date of Patent: Apr. 15, 2008

(54) BILLET LOADER FOR EXTRUSION PRESSES

(75) Inventors: Angelo D'Alessandro, Paderno Dugnano (IT); Mauro Baldassi, Valbrembo (IT)

(73) Assignee: Danieli & C. Officine Meccaniche S.p.A., Buttrio (IT)

( * ) Notice: Subject to any disclaimer, the term of this patent is extended or adjusted under 35 U.S.C. 154(b) by 177 days.

(21) Appl. No.: 10/547,606

(22) PCT Filed: Feb. 25, 2004

(86) PCT No.: PCT/EP2004/001836

§ 371 (c)(1),
(2), (4) Date: Aug. 29, 2005

(87) PCT Pub. No.: WO2004/076088

PCT Pub. Date: Sep. 10, 2004

(65) Prior Publication Data

US 2006/0269388 A1 Nov. 30, 2006

(30) Foreign Application Priority Data

Feb. 27, 2003 (IT) ..... MI2003A0351

(51) Int. Cl.
*B23Q 3/08* (2006.01)

(52) U.S. Cl. ..... 269/32; 269/131

(58) Field of Classification Search ..... 269/32, 269/24–28, 95, 131, 291, 289 R

(56) References Cited

U.S. PATENT DOCUMENTS

| | | | | |
|---|---|---|---|---|
| 2,733,330 | A * | 1/1956 | Blewett | 219/158 |
| 3,741,509 | A * | 6/1973 | Kelly | 248/171 |
| 4,295,257 | A * | 10/1981 | Strohs | 29/240 |
| 5,727,778 | A * | 3/1998 | Nodar | 269/43 |
| 5,755,546 | A | 5/1998 | Jakoby | |
| 7,100,353 | B1 * | 9/2006 | Maguire | 59/7 |

FOREIGN PATENT DOCUMENTS

| | | |
|---|---|---|
| DE | 519 038 | 2/1931 |
| DE | 603 139 | 9/1934 |
| EP | 0 428 989 | 5/1991 |
| JP | 09 271838 | 10/1997 |

* cited by examiner

*Primary Examiner*—Lee D Wilson
(74) *Attorney, Agent, or Firm*—Sampson & Associates P.C.

(57) ABSTRACT

A billet loader for extrusion presses includes a pair of billet grippers supported by two arms. While the first arm is fixed in relation to the supporting structure, the second arm is mobile in relation to the first arm allowing a translational motion along the axis of the billet. The arms are joined together by a chain, which is parallel to the billet-press axis, consisting of links that allow bending in one direction only to form a rigid and continuous supporting device for the billet along its entire length. The billet can consist of one or more workpieces. The chain can be wound in the opposite direction around a rod.

6 Claims, 2 Drawing Sheets

BILLET LOADER FOR EXTRUSION PRESSES

This application claims priority to PCT/EP2004/001836 entitled Billet Loader For Extrusion Presses, filed on 25 Feb. 2004, which claims priority to Italian Patent Application No. MI2003A000351, filed on 27 Feb. 2003.

TECHNICAL FIELD

This invention relates to a loader. More particularly, it relates to a loader of billets, ingots, or bars made of metal, alloy, or other material used to feed extrusion presses suitable for working the specific material.

BACKGROUND

Bars, specifically billets or ingots, are transformed into their final size, shape, and section by means of an extrusion process that forces the material to flow through a shaped opening in a die, reducing and changing the section. One of the most common extrusion techniques involves the use of extrusion presses.

These presses are equipped with loaders that align the billet with the press-centre line and facilitate billet feeding into the container. The billet is pushed into the container by means of a pusher, without moving the container, operated by mechanisms housed in the loader or press.

Alternatively, the billet can be kept suspended between two elements (for example, between the ram and the die); in this case, it is the movement of the container that causes the billet to be fed into the container. The second operating mode is typical of the so-called "Front-Loading presses". In these presses, loading precision—meaning the perfect alignment between the axis of the billet and the axis of the press—becomes a critical parameter for machine reliability.

In general, billets loaded into extrusion presses can consist of a single workpiece or multiple workpieces placed side by side, with the axes parallel. The length of the billets may also vary and depends on the specifications of the press and loader.

The state-of-the-art loaders come in different shapes and sizes and include single-arm, two-arm, and telescopic-arm loaders and two-arm loaders with one arm moving in the direction of the press axis. Document EP-B-428.989 describes the last type of loader (two arms including one mobile one).

This type of loader is unable to support ail billets to be loaded along their entire length, from the minimum to the maximum, during the loading operation without leaving billet segments unsupported.

Document U.S. Pat. No. 5,755,546 describes a single-arm loader equipped with a billet pusher. This billet pusher is moved by a chain that is, in turn, driven by a motor. The pusher pushes the billet into the container.

This type of known loader has several drawbacks including the fact that it is not able to adapt to every billet length usable with the extrusion press.

Another disadvantage of the known loaders is the length of their holding grippers; this length is required to grip the billet securely. The length of the holding grippers determines the length of the shortest billet that can be loaded into the press: the longer the holding grippers, the greater the minimum length of the billet. This is a serious disadvantage since today's markets also demand extrusion presses able to handle very short billets.

Another problem encountered with known loaders is the lack of a continuous and rigid support along the entire length of the billet in the section included between the holding grippers. This is particularly significant when the press is used to extrude simultaneously billets formed by multiple workpieces; this can lead to a misalignment between the different workpieces. In the case of front-loading presses, in particular, this lack of alignment during the extrusion process leads to limited reliability in the loading operation and may cause collisions or scraping damage between the billet and the container.

SUMMARY OF THE INVENTION

It is an object of this invention to resolve the aforementioned problems by providing a loader of billets, ingots, or bars made of metal, alloy, or other material for extrusion presses designed to work these items. The object of this invention is fulfilled by means of a loader with the features claimed in the main claim. Advantageous alternative versions of the loader are described in the dependent claims.

Thanks to its innovative features, the loader of the invention has numerous advantages over the state-of-the-art loaders.

The loader in accordance with the invention has the advantage of adapting very easily to any billet length to be extruded and is able to support every billet to be loaded along its entire length, regardless of its length, without there being any unsupported billet segments.

The loader of the invention has two grippers that hold a very short part of the billet; this is possible because the billets are not just supported by the grippers but also by a chain. As was already mentioned, the length of the billet segment held by the supporting grippers determines the length of the shortest billet that can be loaded into the extrusion press. Hence, in the case of the loader of the invention, a very short billet can be used. This results in a particularly important business and competitive advantage.

The loader of the invention provides a support that, besides being continuous along the entire length of the billet, is also rigid thanks to the type of chain used. This advantage is particularly important when the press must extrude multiple workpieces at a time; the loader of the invention resolves the problem of misalignment between the billets, increasing loading and extrusion reliability and avoiding the danger of collisions or scraping damage between the billet and the container.

BRIEF DESCRIPTION OF THE DRAWINGS

These and other advantages of the invention shall become readily apparent from the more detailed description of preferred embodiments of a loader of billets, ingots, or bars made of metal, alloy, or other material for extrusion presses designed to work these items. This description is given as a non-limiting example and in conjunction with the following accompanying drawings.

DETAILED DESCRIPTION OF PREFERRED EMBODIMENTS OF THE INVENTION

Figure 1:
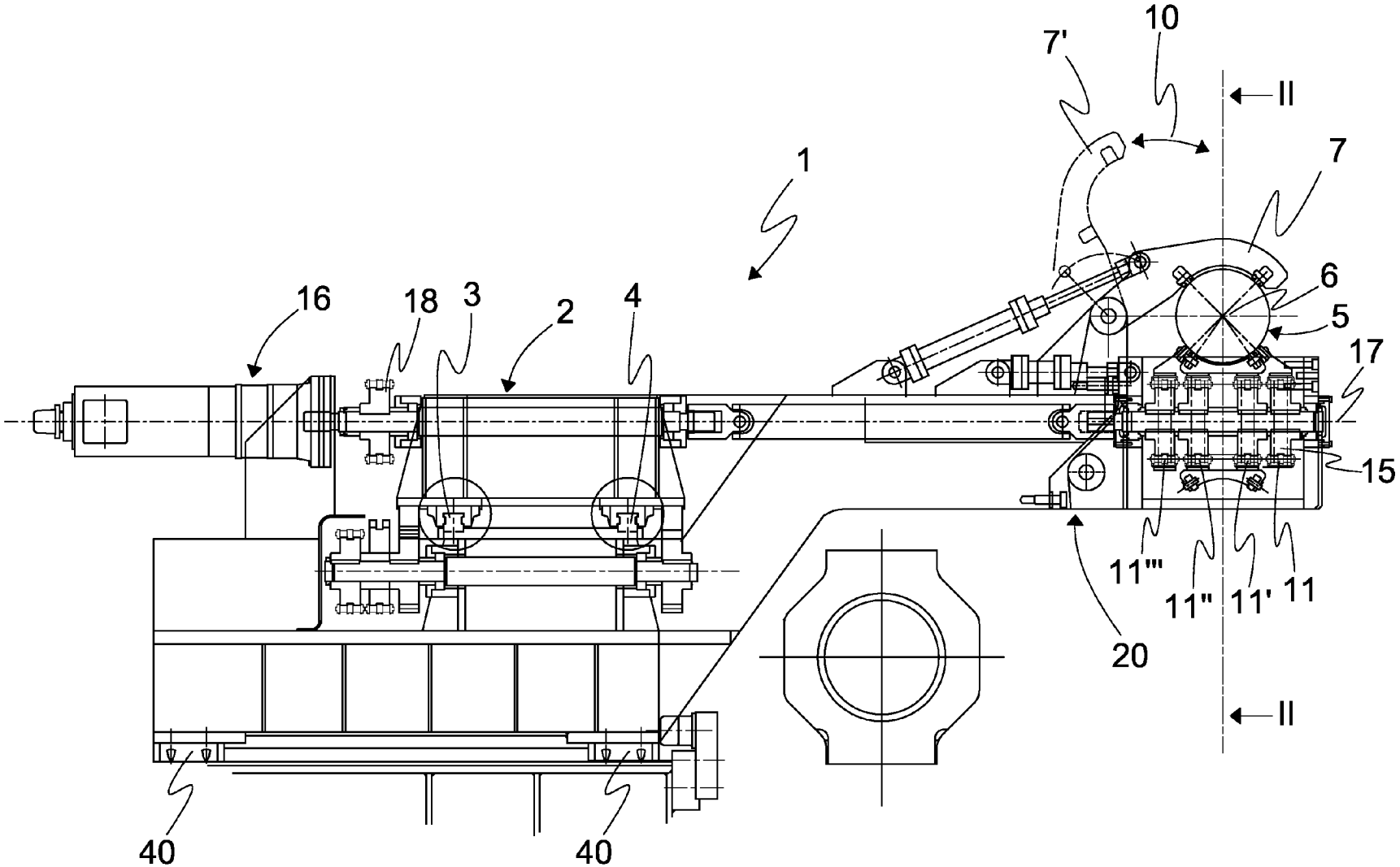
FIG. 1 shows a side view of a billet loader of the invention.
Figure 3:
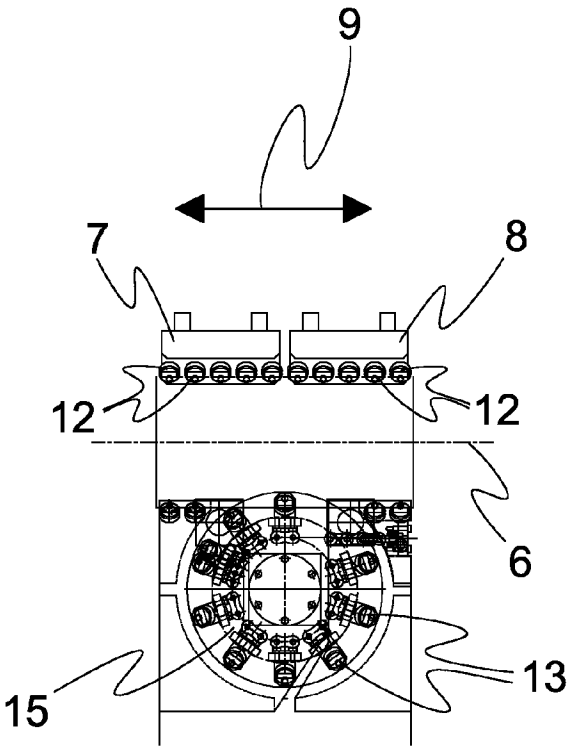
FIG. 3 shows a sectional view along line II-II of a detail of the loader of FIG. 1 in a second operating position.
Figure 2:
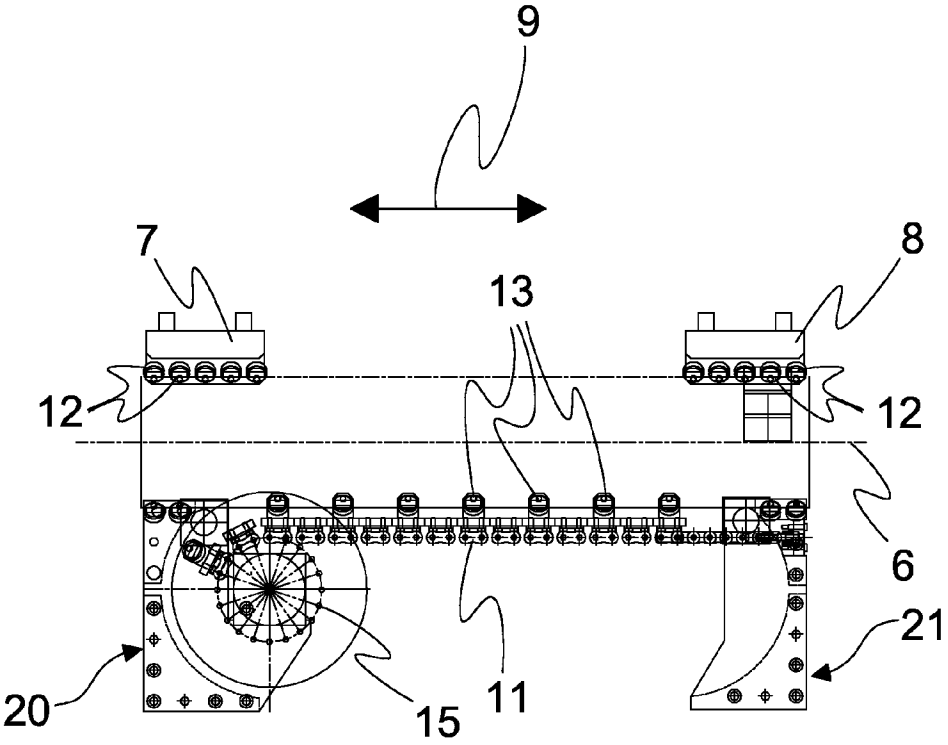
FIG. 2 shows a sectional view along line II-II of a detail of the loader of FIG. 1 in a first operating position.

The figures show a loader, globally referred with numeral 1, of billets, ingots, or bars made of metal, alloy, or other material for extrusion presses designed to work these items.

The loader 1 of the invention is not equipped with an extrusion pusher. The loader 1 consists of a ram 2 that slides along guides 40 and is able to position the billet 5 on the press-centre line 6. If necessary, this ram can be replaced with an arm rotating around a pin or other device able to position the billets, ingots, or bars to be loaded on the press-centre line with a crosswise movement with reference to the press-centre axis. The figures show only some features of the loader of the invention; the figures have been simplified to facilitate understanding. In this description, the term "billets" is used to refer generically to workpieces to be extruded; however, the workpieces can include all metal and non-metal items that can be extruded using extrusion presses. Furthermore, although the given example only discusses one loaded billet, the invention may also apply to cases where multiple workpieces are loaded into the extrusion press.

Two loading arms 20, 21 are mounted onto the ram 2. These arms support two grippers 7, 8 for holding the billet 5. The arm 20 that supports the holding gripper 7 is fixed; while, the second arm 21 is able to move on the guides 3, 4 in a direction parallel to the axis of the press 6, pulling the second gripper 8 with it in the direction of the arrows 9.

The holding grippers 7, 8 are able to open and close by the amount shown by the arrows 10 in order to grip and release the billet. The gripper 7 is also shown in the open position 7' in FIG. 1.

The two holding grippers 7, 8 are connected to each other by means of a special chain 11. Advantageously, the chain 11 comprises several sliding rollers 13 along its entire length to reduce the friction between the billet 5 and the holding grippers 7, 8. Ideally, also the holding grippers 7, 8 have several rollers 12 to reduce the friction with the surface of the billet. In a particularly advantageous version of the invention, the chain consists of several chains 11, 11', 11", 11'" with a similar structure; however, other embodiments with more or less chains than the one shown in FIG. 1 are also possible.

The loading arms 20, 21 are also connected by means of the chain 11. A rod 15 housed inside the fixed arm is used to wind the chain 11 when the arm 21 nears the other arm 20. In the versions with several parallel chains 11, 11', 11", 11'",the winding device consists of several rods positioned coaxially and jointly. This rod 15 is controlled by a motor 16 suitable for making it rotate around its axis 17.

The return of the mobile arm 21—which moves the two arms 20, 21 away along the direction of the arrows 9—to the desired loading position can be controlled by the same motor 16, which is of the reversing type, and is implemented by means of a toothed-belt system, or similar, and gearwheel-rack 18.

The chain 11, which connects the two arms 20, 21, supports the billet 5 along its entire length and consists of links that allow bending in one direction only; this means that the chain will bend around the rod 15 but not in the opposite direction so that the billet 5 can be supported rigidly along its entire length.

The arm 21 of the loader 1 is moved by the chain 11; however, this movement is not necessarily used to push the billet 5 inside the container, not shown in the figures. The movement of the arm 21 adapts the length of the loader 1 to the actual length of the billet 5 to be loaded. Consequently, another advantage of said loader 1 is that it minimizes the dead time of the press during the loading phase, increasing efficiency.

The loader 1 of the invention has another advantage: it can be inserted in the extrusion press between the die and the container of billets or between the ram and the container.

The invention claimed is:

1. A bar loader, for handling one or more workpieces to be fed into an extrusion press, comprising:

a supporting structure, a device able to position the one or more workpieces to be loaded on an axis of the press with a crosswise movement in respect of the axis of the press, a pair of grippers for holding the one or more workpieces, solidarily supported by two respective arms;

wherein a first arm is fixed with respect to the supporting structure and a second arm is mobile with respect to the first arm in the direction of a translational motion parallel to the axis of the press; and wherein said arms are connected by at least one chain arranged essentially parallel to the axis, the chain comprising links that allow bending in one direction only, the chain being rigid in one direction so as to support the one or more workpieces, and being adapted to wind in the opposite direction around a sprocket wheel.

2. A bar loader as claimed in claim 1 wherein the longitudinal element consists of two or more chains reciprocally parallel.

3. A bar loader as claimed in claim 1 wherein the grippers have rollers in the holding area of the one or more workpieces, to reduce contact friction during the movement concerning the one or more workpieces and the grippers.

4. A bar loader as claimed in claim 1 wherein at least one chain comprises rollers along a contact surface with the one or more workpieces, to reduce the contact friction during the movement concerning the chain and one or more workpieces.

5. A bar loader as claimed in claim 1 wherein there are provided motor devices for moving the arms closer to one another and for repositioning them in the starting position.

6. A bar loader as claimed in claim 1 wherein the one or more workpieces are metal or alloy ingot or billet.

* * * * *